US009506641B2

(12) United States Patent
Liu et al.

(10) Patent No.: US 9,506,641 B2
(45) Date of Patent: Nov. 29, 2016

(54) AC LED MODULE HAVING SURGE PROTECTION FUNCTION

(71) Applicant: LUSTROUS TECHNOLOGY LTD., New Taipei City (TW)

(72) Inventors: Chia-Chi Liu, New Taipei (TW); Kao-Hsu Chou, New Taipei (TW); Juei-Khai Liu, New Taipei (TW)

(73) Assignee: LUSTROUS TECHNOLOGY LTD., New Taipei (TW)

( * ) Notice: Subject to any disclaimer, the term of this patent is extended or adjusted under 35 U.S.C. 154(b) by 34 days.

(21) Appl. No.: 14/578,354

(22) Filed: Dec. 20, 2014

(65) Prior Publication Data

US 2016/0109106 A1 Apr. 21, 2016

(30) Foreign Application Priority Data

Oct. 21, 2014 (TW) ..... 103218613 U

(51) Int. Cl.

| | |
|---|---|
| ***F21V 29/00*** | (2015.01) |
| ***F21V 25/00*** | (2006.01) |
| ***F21V 19/00*** | (2006.01) |
| ***F21K 99/00*** | (2016.01) |
| ***F21V 17/00*** | (2006.01) |
| *F21V 7/04* | (2006.01) |
| *F21V 29/77* | (2015.01) |
| *F21Y 101/00* | (2016.01) |

(52) U.S. Cl.

CPC ..... *F21V 25/00* (2013.01); *F21K 9/00* (2013.01); *F21V 17/002* (2013.01); *F21V 19/003* (2013.01); *F21V 7/04* (2013.01); *F21V 29/77* (2015.01); *F21Y 2101/00* (2013.01)

(58) Field of Classification Search

CPC ..... F21V 17/18; F21V 17/06; F21V 17/12; F21V 17/14; F21V 29/77; F21V 25/00; F21V 7/04; F21V 19/003; F21V 17/007; F21K 9/00

USPC ..... 362/294, 341–350

See application file for complete search history.

(56) References Cited

U.S. PATENT DOCUMENTS

| | | | | |
|---|---|---|---|---|
| 6,024,469 | A * | 2/2000 | Greif | F21V 7/09 362/278 |
| 6,614,103 | B1 * | 9/2003 | Durocher | H01L 23/13 257/103 |
| 7,387,403 | B2 * | 6/2008 | Mighetto | F21V 19/003 362/218 |
| 7,527,397 | B2 * | 5/2009 | Li | F21V 29/004 362/240 |
| 7,889,421 | B2 * | 2/2011 | Narendran | H01L 33/507 359/326 |

(Continued)

*Primary Examiner* — Bryon T Gyllstrom

(74) *Attorney, Agent, or Firm* — Guice Patents PLLC

(57) ABSTRACT

An AC LED module having surge protection function includes: an insulation seat, formed with a first surface and a second surface, wherein a concave area is formed on the first surface, and an opening is formed at a substantially central portion of the concave area; an annular fasten member, fastened in the concave area of the insulation seat, and formed with at least one buckle structure for being combined with a reflection cup; a circuit board, installed with a LED light source, wherein the circuit board is fastened on the second surface of the insulation seat, and the LED light source is aligned with the opening; and a surge absorbing member, disposed at the exterior of the insulation seat and electrically coupled to an AC power input port of the circuit board, thereby preventing the circuit board from being damaged by an AC surge.

6 Claims, 4 Drawing Sheets

(56) References Cited

U.S. PATENT DOCUMENTS 8,567,999 B2 * 10/2013 Paik ..... F21S 48/328 362/257
2004/0201987 A1 * 10/2004 Omata ..... H01L 33/486 362/230
2005/0117351 A1 * 6/2005 Kuisma ..... F21K 9/00 362/373
2007/0236935 A1 * 10/2007 Wang ..... F21K 9/00 362/294
2008/0123341 A1 * 5/2008 Chiu ..... F21K 9/137 362/294
2009/0003009 A1 * 1/2009 Tessnow ..... F21K 9/00 362/487
2009/0296414 A1 * 12/2009 Moriyama ..... F21S 8/026 362/373
2012/0113651 A1 * 5/2012 Kuo ..... F21V 13/02 362/311.01
2013/0258672 A1 * 10/2013 Bell ..... F21V 13/04 362/294
2014/0056001 A1 * 2/2014 Hsu ..... F21K 9/135 362/249.02
2016/0109104 A1 * 4/2016 Liu ..... F21V 23/02 362/294

* cited by examiner

AC LED MODULE HAVING SURGE PROTECTION FUNCTION

BACKGROUND OF THE INVENTION

1. Field of the Invention

The present invention relates to an alternating current light emitting diode module (hereinafter referred as an AC LED module), especially to an AC LED module having surge protection function.

2. Description of Related Art

A conventional AC LED module is directly supplied with power through an AC power source, and a power converter is not adopted. As such, when the AC power source generates a high voltage surge, the above-mentioned AC LED module is very likely to be damaged. In addition, for being combined with a reflection cup, one surface defined on a housing of the conventional AC LED module is formed with a reflection cup accommodating concave surface.

For preventing an AC LED module from being damaged by a high voltage surge, the prior art is to install a surge absorbing member in the AC LED module. However, the installation of the surge absorbing member would cause the depth of the reflection cup accommodating concave surface of the AC LED module to be increased, so a mechanical interference may be generated between a reflection cup having a larger dimension and the reflection cup accommodating concave surface thereby not allowing the reflection cup to be combined with the AC LED module.

In view of the above-mentioned disadvantages, a novel AC LED module shall be invented.

SUMMARY OF THE INVENTION

One primary objective of the present invention is to provide an AC LED module having surge protection function, in which a surge absorbing member is installed for preventing an AC LED module from being damaged by an AC surge Another objective of the present invention is to provide an AC LED module having surge protection function, in which a surge absorbing member is disposed at the exterior of an insulation seat thereby enabling the insulation seat to be formed in a small thickness, so the small-thickness insulation seat is able to accommodate a reflection cup having various dimensions For achieving said objectives, the present invention provides an AC LED module having surge protection function, which includes:

an insulation seat, formed with a first surface and a second surface, wherein a concave area is formed on the first surface, and an opening is formed at a substantially central portion of the concave area;

an annular fasten member, fastened in the concave area of the insulation seat, and formed with at least one buckle structure for being combined with a reflection cup;

a circuit board, installed with a LED light source, wherein the circuit board is fastened on the second surface of the insulation seat, and the LED light source is aligned with the opening; and a surge absorbing member, disposed at the exterior of the insulation seat and electrically coupled to an AC power input port of the circuit board, thereby preventing the circuit board from being damaged by an AC surge.

According to one embodiment of the present invention, the annular fasten member is fastened in the concave area of the insulation seat by utilizing at least one screw member.

According to one embodiment of the present invention, the annular fasten member is made of a metal material.

According to one embodiment of the present invention, the reflection cup is combined with the at least one buckle structure with a rotating fitting means.

According to one embodiment of the present invention, the circuit board is made of an aluminum substrate.

According to one embodiment of the present invention, the AC LED module having surge protection function further includes a heat dissipation base which is in contact with one surface of the circuit board.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
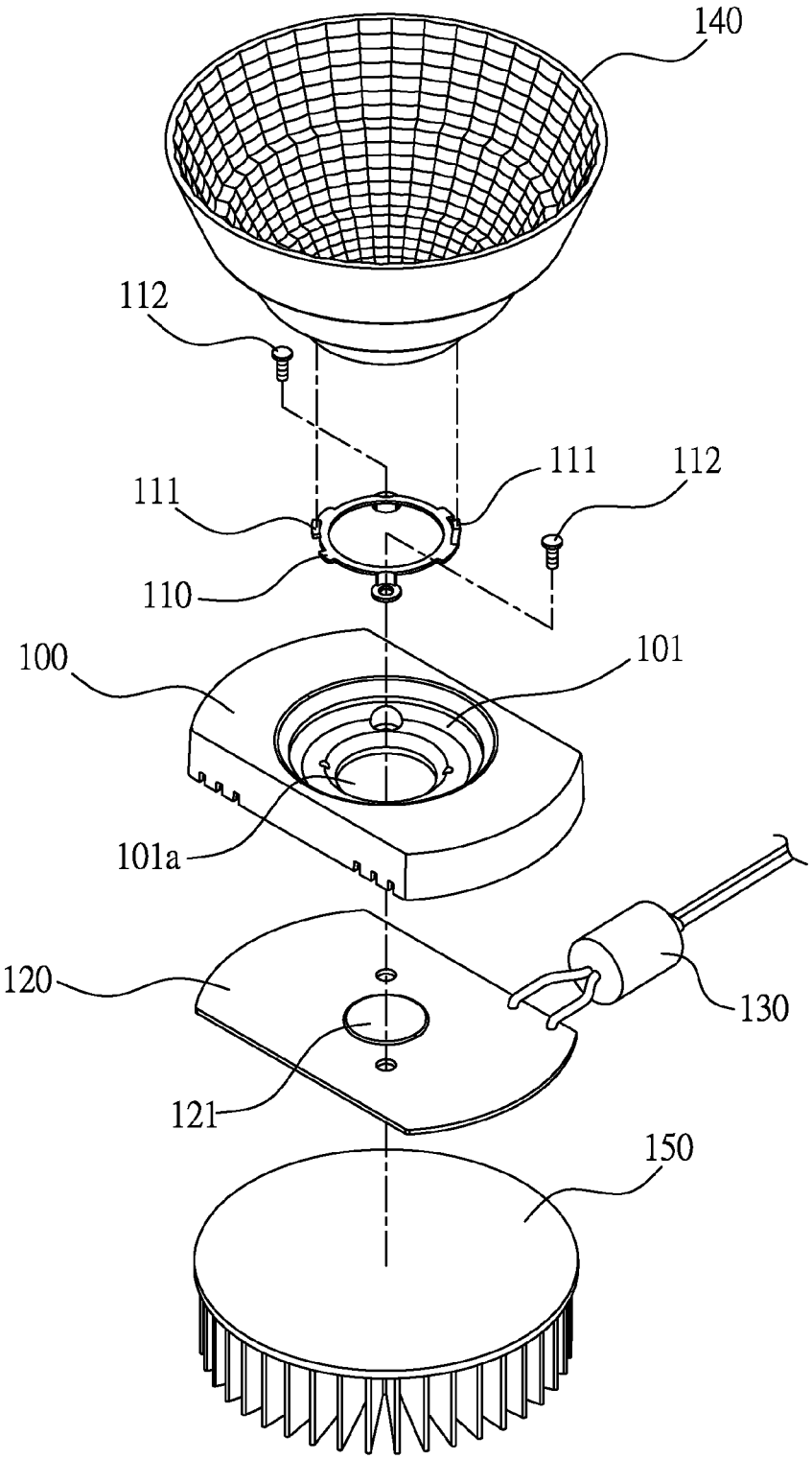
FIG. 1 is an exploded view illustrating an AC LED module having surge protection function according to one embodiment of the present invention.
Figure 2:
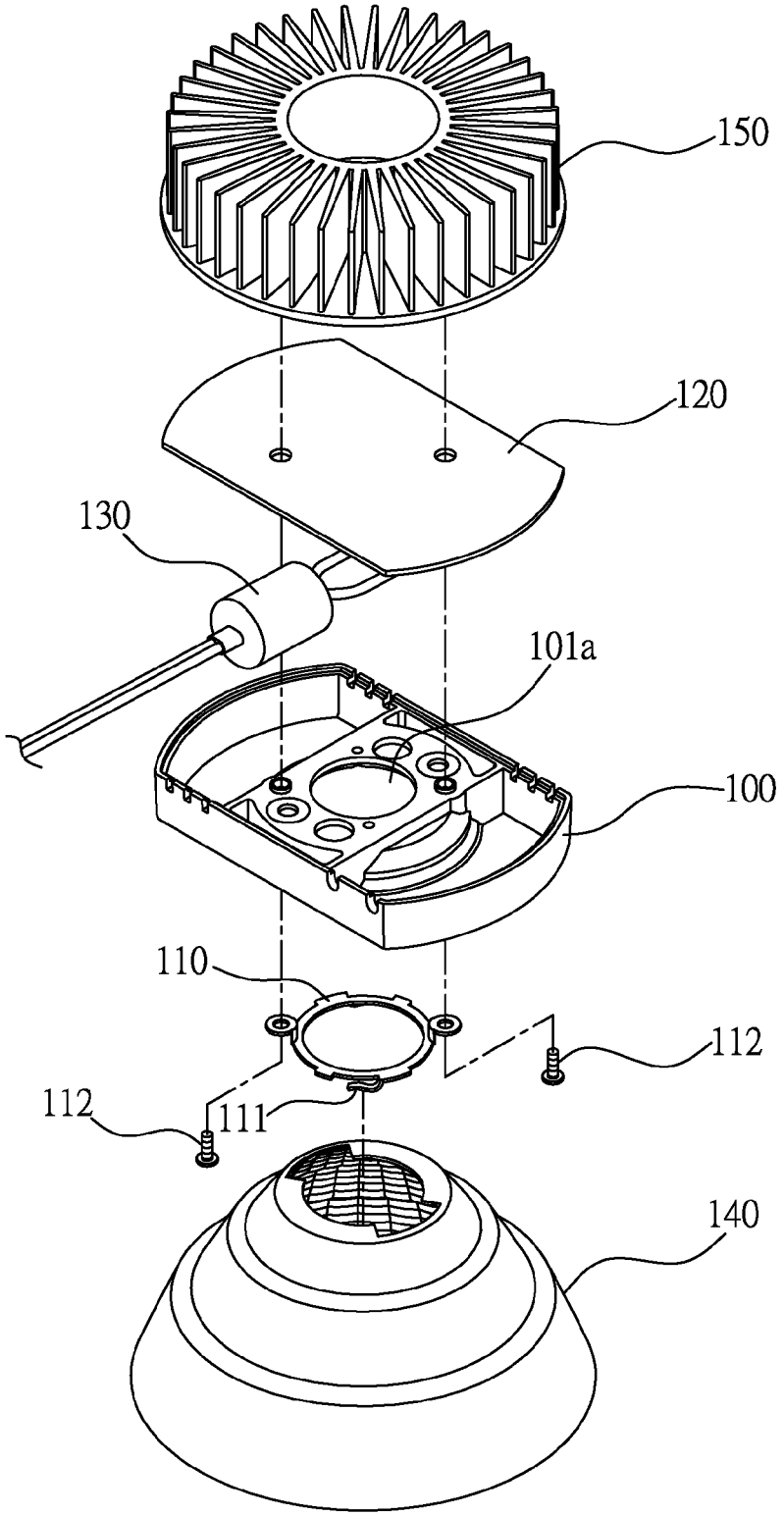
FIG. 2 is another exploded view illustrating the AC LED module having surge protection function according to one embodiment of the present invention.

Referring to FIG. 1 and FIG. 2, which are exploded views illustrating an AC LED module having surge protection function according to one embodiment of the present invention. As shown in FIG. 1 and FIG. 2, the AC LED module having surge protection function includes an insulation seat 100, an annular fasten member 110, a circuit board 120, a surge absorbing member 130, a reflection cup 140 and a heat dissipation base 150.

The insulation seat 100 is formed with a first surface and a second surface, wherein a concave area 101 is formed on the first surface, and an opening 101*a* is formed at a substantially central portion of the concave area 101.

The annular fasten member 110 is fastened in the above-mentioned concave area 101 of the insulation seat 100, and formed with at least one buckle structure 111 for being combined with the reflection cup 140. According to the embodiment disclosed in FIG. 1 and FIG. 2, the annular fasten member 110 is fastened in the above-mentioned concave area 101 of the insulation seat 100 by utilizing at least one screw member 112; the annular fasten member 110 is made of a metal material; and the above-mentioned reflection cup 140 is combined with the at least one buckle structure 111 with a rotating fitting means.

The circuit board 120 is installed with a LED light source 121, wherein the circuit board 120 is fastened on the second surface of the insulation seat 100, and the LED light source 121 is able to be aligned with the opening 101*a* when the circuit board 120 is combined with the insulation seat 100. In addition, the circuit board 120 can be made of an aluminum substrate for the purpose of heat dissipation.

The surge absorbing member 130 is electrically coupled to an AC power input port of the circuit board 120, thereby preventing the circuit board 120 from being damaged by a high voltage surge. The technical feature of the surge absorbing member 130 is that: when a high voltage surge is generated, the resistance value of the surge absorbing member 130 is able to be smaller for absorbing most of the power of the high voltage surge so as to prevent the circuit board 120 from being damaged.

The reflection cup 140 is served to define an illuminating direction. What shall be addressed is that the opened portion of the reflection cup 140 can be formed in different dimensions.

The heat dissipation base 150 is in contact with one surface of the circuit board 120 for providing a heat dissipation function.

Figure 3:
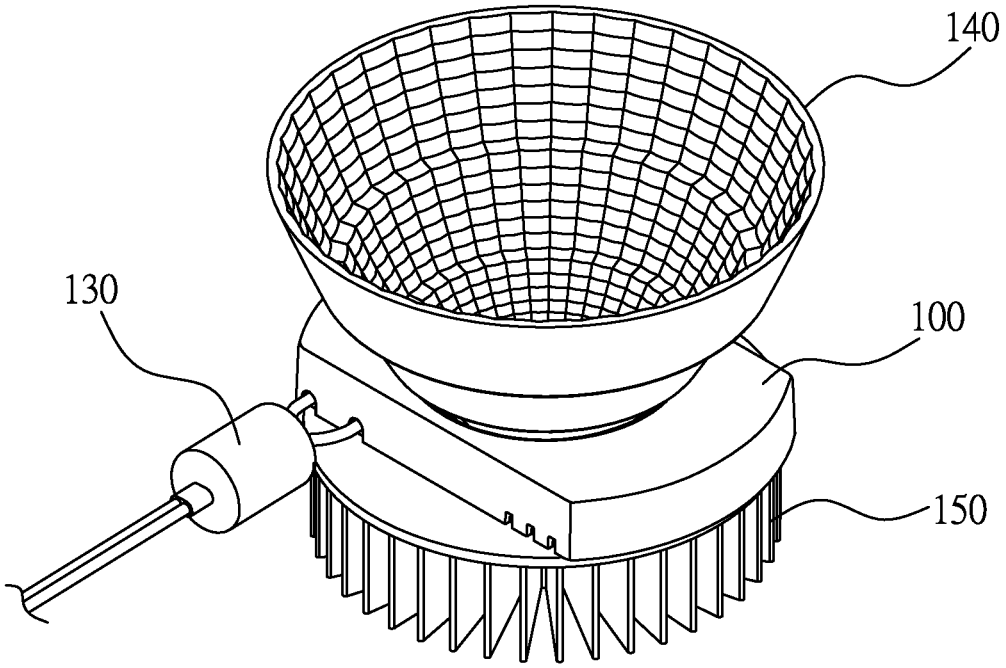
FIG. 3 is a schematic view illustrating the assembly of the AC LED module having surge protection function according to one embodiment of the present invention.
Figure 4A:
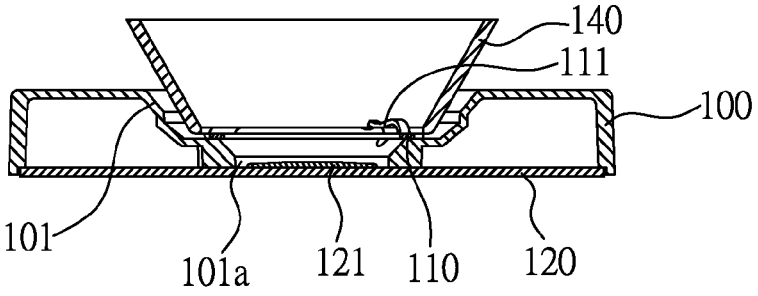
FIG. 4*a* to FIG. 4*c* are cross sectional views illustrating the AC LED module having surge protection function being respectively combined with a reflection cup having three different dimensions.
Figure 4B:
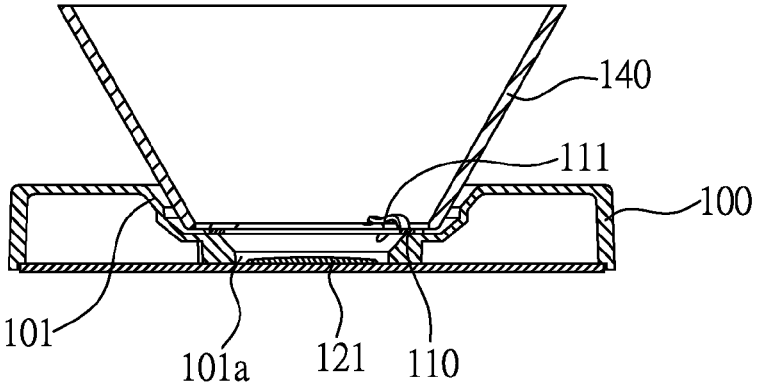
Figure 4C:
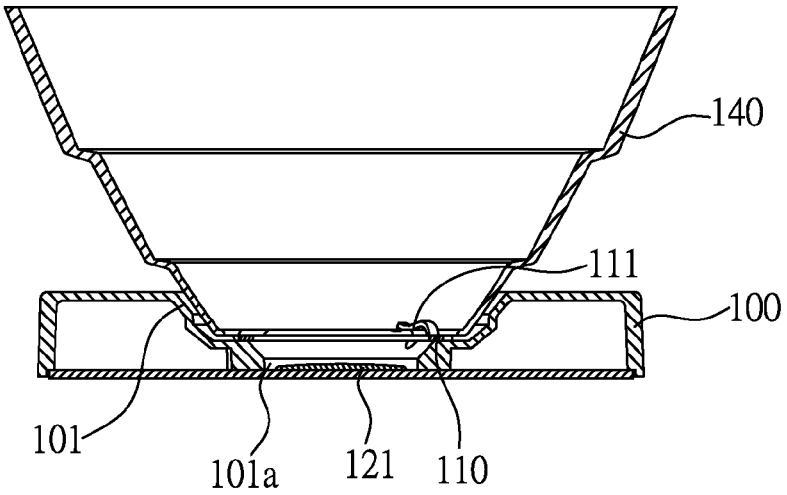

Referring to FIG. 3, which is a schematic view illustrating the assembly of the AC LED module having surge protection function according to one embodiment of the present invention. As shown in FIG. 3, the surge absorbing member 130 of the AC LED module having surge protection function is disposed at the exterior of the insulation seat 100 for providing an AC surge protection function. Because the surge absorbing member 130 is disposed at the exterior of the insulation seat 100, the height of the above-mentioned concave area 101 of the insulation seat 100 can still be minimized thereby preventing a mechanical interference from being generated between the reflection cup 140 and the above-mentioned concave area 101, so the reflection cup 140 are enabled to be formed in various dimensions and still can be accommodated. Referring from FIG. 4*a* to FIG. 4*c*, which are cross sectional views illustrating the AC LED module having surge protection function being respectively combined with the reflection cup having three different dimensions.

Based on what has been disclosed above, advantages achieved by the present invention are as followings:

1. The AC LED module having surge protection function provided by the present invention is installed with the surge absorbing member for preventing an AC LED module from being damaged by an AC surge.
2. The AC LED module having surge protection function provided by the present invention allows the surge absorbing member to be disposed at the exterior of the insulation seat thereby enabling the insulation seat to be formed in a small thickness, so the small-thickness insulation seat is able to accommodate the reflection cup having various dimensions.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. An AC LED module having surge protection function, including:

an insulation seat, formed with a first surface and a second surface, said first surface and said second surface are located on opposite sides of said insulation seat, wherein a concave area being formed on said first surface, and an opening is formed at a substantially central portion of said concave area;

an annular fasten member, fastened in said concave area of said insulation seat, and formed with at least one buckle structure for being combined with a reflection cup;

a circuit board, installed with a LED light source, wherein said circuit board being fastened on said second surface of said insulation seat and said reflection cup being fastened to said first surface of said insulation seat, and said LED light source being aligned with said opening; and a surge absorbing member disposed externally adjacent said insulation seat and electrically coupled to an AC power input port of said circuit board, thereby preventing said circuit board from being damaged by an AC surge;

wherein the insulation seat is located between the circuit board and the reflection cup.

2. The AC LED module having surge protection function as claimed in claim 1, wherein said annular fasten member is fastened in said concave area of said insulation seat by utilizing at least one screw member.

3. The AC LED module having surge protection function as claimed in claim 1, wherein said annular fasten member is made of a metal material.

4. The AC LED module having surge protection function as claimed in claim 1, wherein said reflection cup is combined with said at least one buckle structure with a rotating fitting means.

5. The AC LED module having surge protection function as claimed in claim 1, wherein said circuit board is made of an aluminum substrate.

6. The AC LED module having surge protection function as claimed in claim 1, further including a heat dissipation base in contact with one surface of said circuit board.

* * * * *